United States Patent [19]

Werner

[11] 4,439,879

[45] Apr. 3, 1984

[54] ADJUSTABLE BED WITH IMPROVED CASTOR CONTROL ASSEMBLY

[75] Inventor: Lester W. Werner, St. Louis, Mo.

[73] Assignee: B-W Health Products, Inc., Maryland Heights, Mo.

[21] Appl. No.: 211,542

[22] Filed: Dec. 1, 1980

[51] Int. Cl.[3] ..... A61G 7/00

[52] U.S. Cl. ..... 5/60; 5/66; 5/86

[58] Field of Search ..... 5/60, 86; 296/20; 16/35 R

[56] References Cited

U.S. PATENT DOCUMENTS

| | | | |
|---|---|---|---|
| 961,807 | 6/1910 | Seibert | 16/35 R |
| 2,114,586 | 4/1938 | Bowen | 16/35 R |
| 2,684,734 | 7/1954 | Wilson | 16/35 R |
| 3,036,314 | 5/1962 | Wetzler | 5/63 |
| 3,304,116 | 2/1967 | Stryker | 5/86 X |

FOREIGN PATENT DOCUMENTS

| | | | |
|---|---|---|---|
| 432756 | of 1967 | Switzerland | 16/35 R |
| 570802 | 12/1975 | Switzerland | 5/60 R |
| 2033742 | 4/1980 | United Kingdom | 16/35 R |

*Primary Examiner*—Gary L. Smith
*Assistant Examiner*—Michael F. Trettel
*Attorney, Agent, or Firm*—Gravely, Lieder & Woodruff

[57] ABSTRACT

A castor control assembly for an adjustable bed includes a linkage mechanism having rigid link elements, and a single pedal actuator. The pedal may be actuated from the control station to shift the linkage mechanism and operate individual castors for selection of swivel, locking and steering modes, as desired.

3 Claims, 8 Drawing Figures

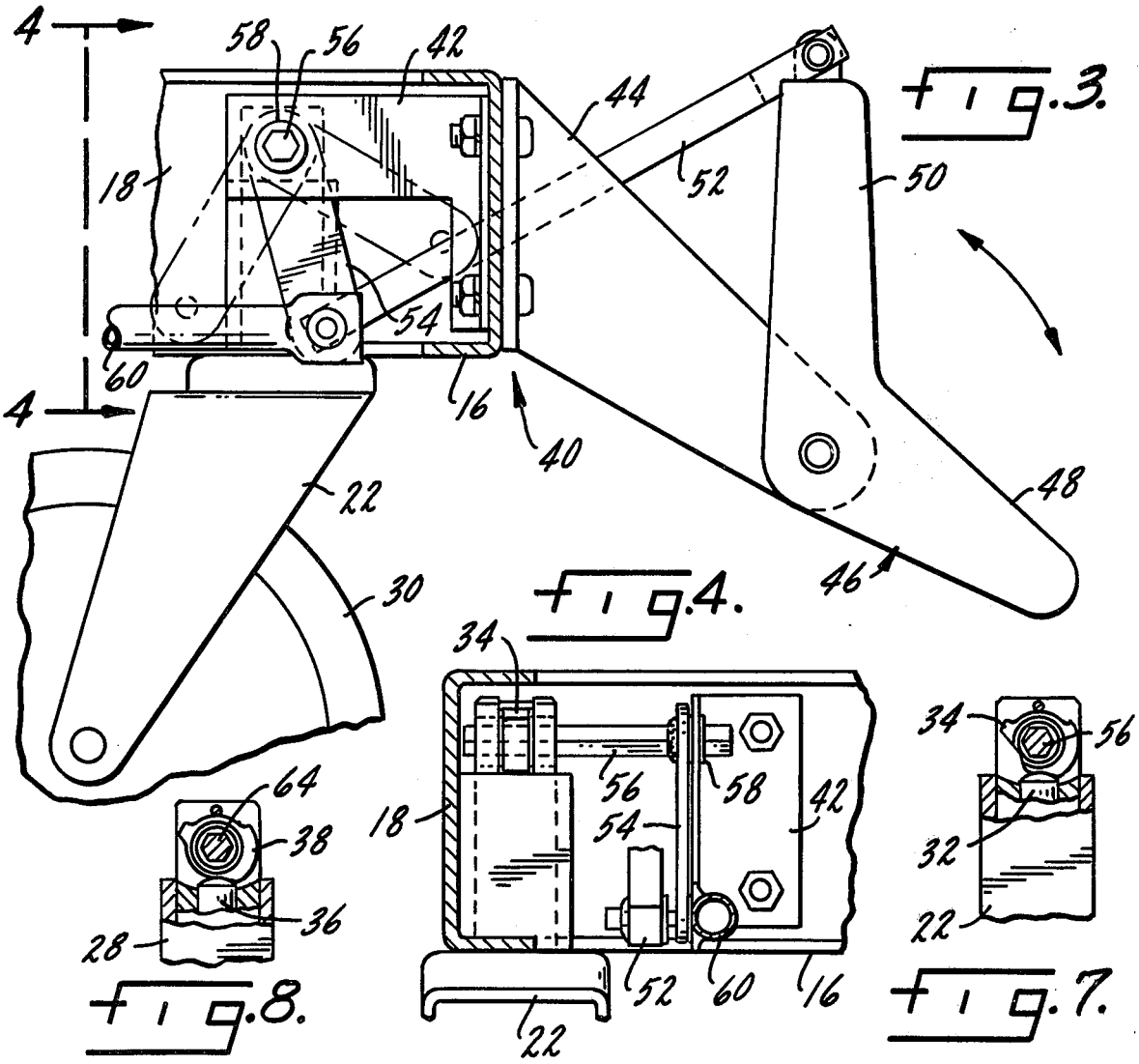
Fig. 3.
Fig. 4.
Fig. 7.
Fig. 8.
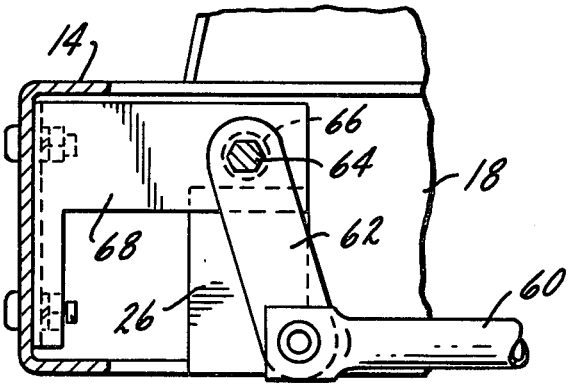
Fig. 5.
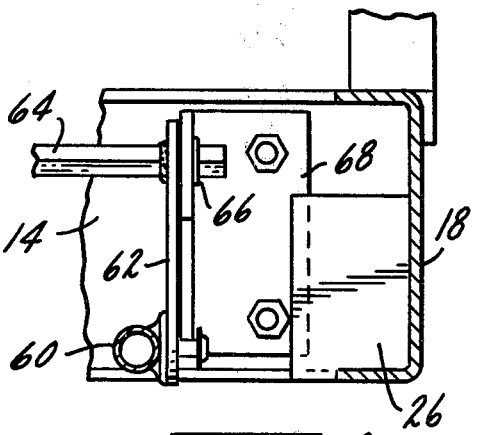
Fig. 6.

ADJUSTABLE BED WITH IMPROVED CASTOR CONTROL ASSEMBLY

BACKGROUND OF THE INVENTION

This invention relates generally to controlling the movement of adjustable beds. More particularly, it relates to an improved assembly for controlling the castors associated with a hospital bed.

In a hospital enviornment, it is necessary for a bed to be provided with multiple functional capabilities. Such a bed must be free to swivel so as to be readily positionable; must be lockable so as to prevent movement thereof, and must be steerable for effective patient transport. Suitable castors are available for providing these functions. The control of such castors, however, is in need of improvement.

In the past, a typical assembly for controlling the castors associated with a hospital bed incorporated separate operators for each individual castor, which operators included pedals located at the sides of the bed. This required that an attendant leave the control station, which generally is at the foot of the bed, in order to use the assembly. Such an assembly also incorporated cables associated with the pedals. These cables could come out of adjustment, resulting in improper function.

There remains a need in the art to provide a simple, inexpensive, efficient, long-wearing assembly for controlling the castors associated with a hospital bed. The assembly preferably should be located at or adjacent the control station at the foot of the bed, and should not be capable of easily coming out of adjustment.

SUMMARY OF THE INVENTION

The primary object of this invention is to meet the needs noted above. To that end, there is provided a pedal-actuated linkage mechanism which constitutes a control assembly for establishing the various functional modes necessary for a hospital bed. The pedal is located at the control station so that an attendant may easily select the mode desired. The linkage mechanism incorporates rigid link elements associated with selected cam actuators for associated castors.

The pedal is selectively movable to swivel, locking and steering positions. Pedal movement shifts the linkage mechanism, and selected cams are rotated thereby in such a manner that the castors establish the desired functional modes. The linkage mechanism incorporates rigid link elements to ensure that the assembly cannot come out of adjustment and cause improper functional selection.

The result is a simple, inexpensive, efficient, long-wearing assembly for controlling the castors associated with a hospital bed.

BRIEF DESCRIPTION OF THE DRAWINGS

The objects and advantages of this invention will become apparent to those skilled in the art upon careful consideration of the specification herein, including the drawings, wherein:

FIG. 3 is a sectional view taken along the line 3—3 of FIG. 2 showing details of the pedal and linkage mechanism;

FIG. 4 is a sectional view taken along the line 4—4 of FIG. 3 showing additional details of the pedal and linkage mechanism;

FIG. 5 is a sectional view taken along the line 5—5 of FIG. 2 showing additional details of the linkage mechanism;

FIG. 6 is a sectional view taken along the line 6—6 of FIG. 2 showing additional details of the linkage mechanism;

FIG. 7 is a detail view showing one of the castor and cam arrangements; and

FIG. 8 is a detail view showing another of the castor and cam arrangements.

Figure 1:
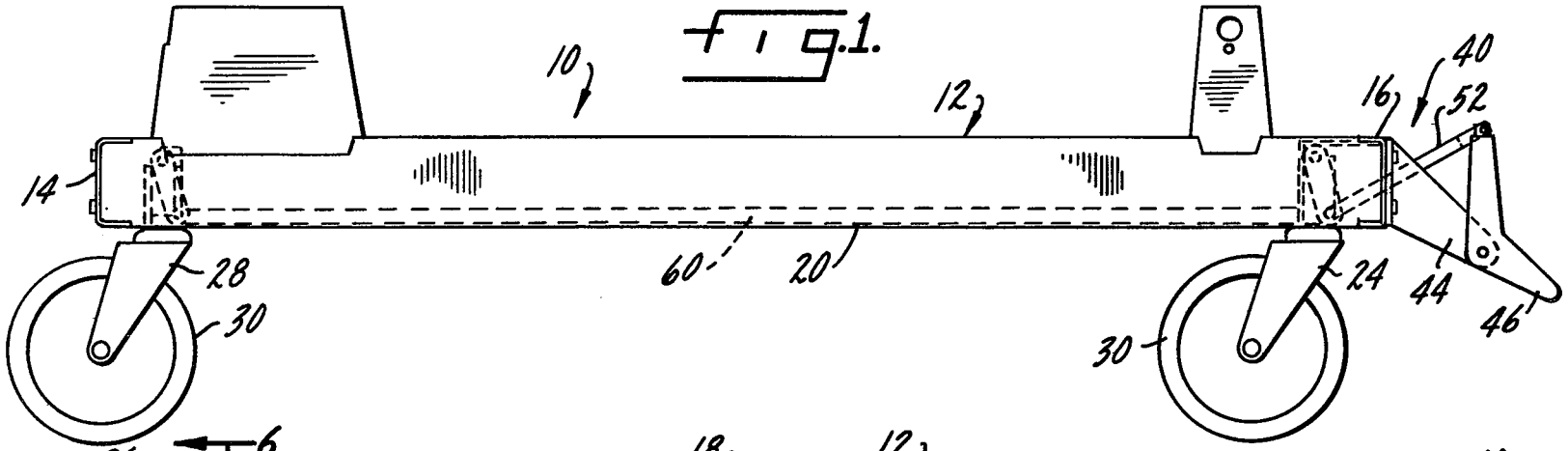
FIG. 1 is an elevational view of the lower frame of a hospital bed showing the arrangement of the castors and control assembly.
Figure 2:
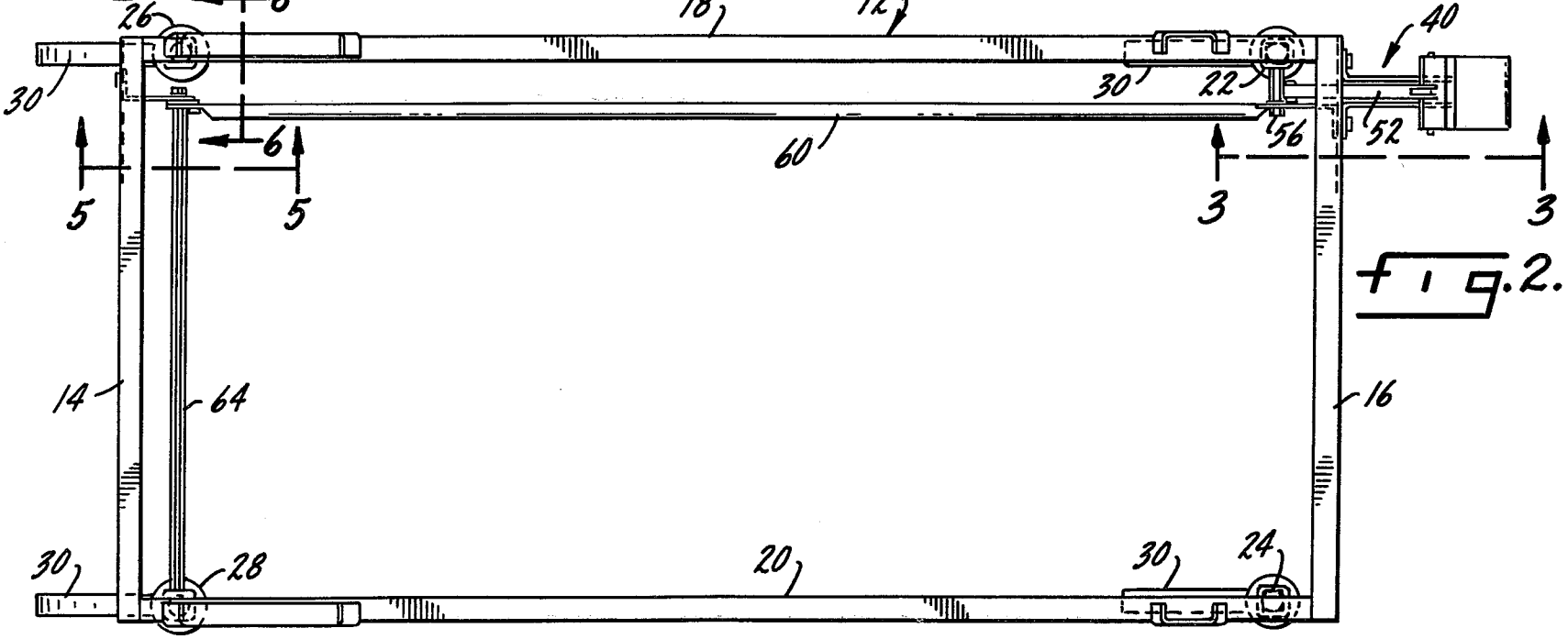
FIG. 2 is a plan view of the frame, castors and control assembly shown in FIG. 1.

While this invention is susceptible of embodiment in many different forms, there is shown in the drawings and herein will be described in detail a preferred embodiment. It should be understood that the present disclosure is considered to be an exemplification of the principles of the invention, and is not intended to limit the invention to this embodiment.

DESCRIPTION OF A PREFERRED EMBODIMENT

Referring now to the drawings in greater detail, there is shown generally a portion of a typical hospital bed 10. Bed 10 includes a lower frame 12 having a head member 14, a foot member 16 and first and second side members 18 and 20 joining members 14 and 16.

Castors 22, 24, 26 and 28 are mounted at the corners of lower frame 12, with each castor supporting one end of a side member 18 or 20 adjacaent an associated head member 14 or foot member 16. Each castor includes a wheel 30.

In a preferred form of the invention, foot castor 22 includes a movable plunger 32 and a first cam 34. Plunger 32 is movable from a first, intermediate swivel position to a second, lower locking position in which wheel 30 is locked, and to a third, upper steering position in which wheel 30 can roll but castor 22 cannot swivel. Cam 34 has three lobes. With a three-lobed cam, rotation thereof moves plunger 32 selectively to its first, second and third positions to establish respectively the swivel, locking and steering modes.

Similarly, head castor 28 includes a movable plunger 36 and a second cam 38. Plunger 36 is movable as is plunger 32. However, cam 38 has two lobes. With a two-lobed cam, rotation thereof moves plunger 36 selectively to its first and second positions to establish respectively the swivel and locking modes. Rotation of the two-lobed cam to what normally would be the third position has no effect on plunger 36. Rather, the cam configuration is such that plunger 36 remains in its first position and castor 28 remains in the swivel mode.

Castors of this type and their associated cams are commercially available, and need not be described further in detail.

A control assembly 40 is provided for rotating cams 34 and 38 so as to place castors 22 and 28 in the swivel, locking and steering modes, as desired.

Assembly 40 includes a bracket 42 secured to foot member 16 and extending inwardly in a direction generally parallel to side member 18. Similarly, a bracket 44 is secured to foot member 16 and extends outwardly therefrom at the control station. In a preferred form of the invention, bracket 44 is located adjacent side member 18 and extends generally parallel thereto.

An actuator in the form of a foot pedal 46 or the like is pivoted to bracket 44. Pedal 46 includes a heel portion 48 and a toe portion 50. Pedal 46 may be pivoted clockwise, as shown in FIG. 3, by the application of pressure to heel portion 48. Similarly, pedal 46 may be pivoted counterclockwise by the application of pressure to toe portion 50. This may be accomplished by an attendant without leaving the control station.

A tie rod element 52 is pivoted to toe portion 50 of pedal 46. Tie rod 52 extends through a convenient opening in foot member 16. A first link element 54 is pivoted at one end to tie rod 52. The other end of link 54 is rigidly secured to a first shaft element 56, which in turn is suitably journalled at 58 for rotation relative to bracket 42. In a preferred form of the invention, shaft 56 is of polygonal configuration, and is engaged in a corresponding polygonal opening in cam 34.

Thus, it will be seen that pivotal movement of pedal 46 shifts tie rod 52 and link 54, which in turn rotates shaft 56 such that cam 34 is rotated. Pedal 46 may be pivoted selectively to swivel, locking and steering positions corresponding to the swivel, locking and steering modes of castor 22.

A connecting rod element 60 extends generally parallel to side member 18, and is pivoted at one end to tie rod 52. The other end of connecting rod 60 is pivoted to a second link element 62. In turn, link 62 is rigidly secured to a second shaft element 64 which is journalled by a suitable bearing 66 in a bracket 68. Bracket 68 is secured to head member 14 and extends inwardly generally parallel to side member 18.

Side member 18, connecting rod 60 and links 54 and 62 form parallelogram linkage pivotable about the axes of shafts 56 and 64 to thereby rotate the shafts.

Shaft 64 extends generally parallel to head member 14 into engagement with cam 38. Actuation of castor 28 is the same as that of castor 22 described above. Shaft 64 preferably is of polygonal configuration so as to conform to the polygonal opening in cam 38.

In a preferred form of the invention, castor 22 is provided with a cam 34 having three lobes, and thus is shiftable to swivel, locking and steering modes. Castor 28 is provided with a cam 38 having two lobes, and thus is shiftable with castor 22 to swivel and locking modes. Castor 28 remains in the swivel mode when assembly 40 is actuated to shift castor 22 to the steering mode.

As shown in FIG. 3, pedal 46 is in the swivel position. Assembly 40 is oriented such that cams 34 and 38 place castors 22 and 28 in the swivel mode. In this mode, bed 10 may be moved easily in any direction.

Clockwise pivoting of pedal 46 shifts assembly 40 such that cams 34 and 38 place castors 22 and 28 in the locking mode. They may not swivel, nor may wheels 30 roll. In this mode, bed 10 may not be moved.

Pivoting of pedal 46 counterclockwise shifts assembly 40 in the opposite direction such that castor 22 is placed in the steering mode, wherein it may not swivel but wheel 30 is free to roll. At the same time, castor 28 remains in the swivel mode. In this mode, an attendant may move bed 10 while steering it, so as to transport a patient. In this regard, an attendant typically pushes bed 10 from head member 14.

In a preferred form of the invention, diagonally opposed casters 22 and 28 are subject to control by assembly 40. Similarly, the opposite diagonally opposed casters 24 and 26 are free and remain in the swivel mode. It should be understood, however, that the number and orientation of castors subject to control by assembly 40 is a matter of choice.

It should be apparent to those skilled in the art that there is disclosed herein an improved assembly for controlling the castors associated with a hospital bed, which assembly may be actuated easily by an attendant at the control station. The assembly is comprised of rigid linkage, and thus may not come out of adjustment. It is simple, inexpensive, efficient and long-wearing, and may be serviced easily in the field.

It is not intended that the present invention be restricted in its application to the hospital bed shown herein by way of example. It is contemplated that the invention will be utilized in a wide variety of applications in which it is desirable to control castors associated with a frame.

It should be understood that while a preferred embodiment of the invention has been shown and described, this is to be considered as illustrative and may be modified by those skilled in the art. It is intended that the claims herein cover all such modifications as may fall within the spirit and scope of the invention.

What is claimed is:

1. In an adjustable hospital bed having head, foot and side members, a plurality of cam-operated castors supporting said members, and an assembly for controlling operation of said castors; the improvement wherein said assembly comprises an actuator movable selectively to swivel, locking and steering positions, said actuator being a pedal pivotably supported adjacent said foot member, whereby the castors may be selectively actuated from a control station at the foot of the bed, a linkage mechanism having rigid elements operatively engaged with said actuator and at least two of said castors and including a series of links, connecting rods and rotatable shafts, at least one of said castors including a first cam for operation thereof selectively by a first rotatable shaft to swivel, locking and steering modes in response to movement of said actuator to its swivel, locking and steering positions, and at least one other of said castors including a second cam for operation thereof selectively by a second rotatable shaft to swivel and locking modes in response to movement of said actuator to its swivel and locking positions and retention thereof in said swivel mode in response to movement of said actuator to its steering position, said one castor supporting a corner of the bed formed by said foot member and a side member, and said other castor supporting a corner of the bed formed by said head member and a side member, said corners being diagonally opposed.

2. In an adjustable bed having head, foot and side members, a plurality of camoperated castors supporting said members, and an assembly for controlling operation of said castors; the improvement wherein said assembly comprises an actuator movable selectively to swivel, locking and steering positions, said actuator being a pedal pivotably supported adjacent said foot member, whereby the castors may be selectively actuated from a control station at the foot of the bed, a linkage mechanism having rigid elements operatively engaged with said actuator and two of said castors positioned at diagonally opposed corners of said bed, one of said castors including a first cam for operation thereof selectively to swivel, locking and steering modes in response to movement of said actuator to its swivel, locking and steering positions, and the other of said castors including a second cam for operation thereof selectively to swivel and locking modes in response to movement of said actuator to its swivel and locking positions and retention thereof in said swivel mode in response to movement of said actuator to its steering position, said linkage mechanism including first and second shafts, said first and second shafts respectively engaged with said first and second cams for operation thereof, first and second link elements respectively engaged with said first and second shafts for operation thereof, a connecting rod engaged with said link elements, said shafts extending in opposite directions from said connecting rod and a tie rod engaged with said connecting rod and said pedal, whereby actuation of said pedal moves said connecting rod and thereby rotates the shafts through the link elements to select the modes of said castors.

3. The invention of claim 2, said one side member, first and second links and connecting rod forming parallelogram linkage pivotable about the axes of said first and second shafts for rotation thereof, said parallelogram linkage being pivotable by said tie rod in response to pivoting of said pedal to thereby select said modes of said castors.

* * * * *